US011737590B2

(12) United States Patent
Buchanan

(10) Patent No.: US 11,737,590 B2
(45) Date of Patent: Aug. 29, 2023

(54) RECONFIGURABLE BEDDING STABILITY SYSTEM

(71) Applicant: Ann Buchanan, Lawrenceville, GA (US)

(72) Inventor: Ann Buchanan, Lawrenceville, GA (US)

( * ) Notice: Subject to any disclaimer, the term of this patent is extended or adjusted under 35 U.S.C. 154(b) by 82 days.

(21) Appl. No.: 17/160,321

(22) Filed: Jan. 27, 2021

(65) Prior Publication Data

US 2022/0233004 A1 Jul. 28, 2022

(51) Int. Cl.
*A47G 9/02* (2006.01)

(52) U.S. Cl.
CPC ..... *A47G 9/0246* (2013.01); *A47G 9/0223* (2013.01)

(58) Field of Classification Search
CPC ..... A47G 9/0246; A47G 9/0223; A47G 9/02
See application file for complete search history.

(56) References Cited

U.S. PATENT DOCUMENTS 2,789,292 A * 4/1957 Budinquest ..... A47G 9/02 5/494
3,355,748 A * 12/1967 Tuvert ..... A47G 9/02 24/103
3,832,743 A 9/1974 Smith
3,859,678 A * 1/1975 Davis ..... A47G 9/02 5/500
3,962,739 A * 6/1976 Crockett ..... A47G 9/02 5/500
3,965,504 A 6/1976 Ainsworth
4,040,133 A 8/1977 Gilreath
4,145,778 A * 3/1979 Ferrante ..... A47G 9/02 5/500
4,237,805 A * 12/1980 Ferrante ..... A47G 9/02 112/475.08
4,308,626 A * 1/1982 Weiss ..... A47G 9/0246 5/497
4,903,361 A * 2/1990 Tang ..... A47G 9/02 5/500
5,042,099 A 8/1991 Brenner et al.
5,099,531 A 3/1992 Schmier
5,189,744 A * 3/1993 Roberts ..... A47G 9/0246 5/497
5,321,862 A 6/1994 Campbell
5,465,440 A * 11/1995 Heptner ..... A47G 9/0246 5/497
5,884,349 A * 3/1999 Gretsinger ..... A47G 9/02 5/497

(Continued)

*Primary Examiner* — Eric J Kurilla
(74) *Attorney, Agent, or Firm* — Denton Intellectual Property Law Firm, LLC

(57) ABSTRACT

The invention provides an invertible bedding stability system comprising a fitted sheet, a top sheet that resembles a flat sheet at the head end and fitted sheet at the foot end, and a cover bearing a constellation of buttons. The top sheet is sewn by a seam to the fitted sheet along their foot end and one side, such that elastic straps are sandwiched between them and bisected by that seam. The elastic straps define button holes; the external half of each strap may mate to one or more respective buttons on the cover. When the system is mounted on an intended mattress, the bedding remains more reliably in a fully or partially made-bed state, thereby improving the user's sleeping experience.

20 Claims, 8 Drawing Sheets

(56) References Cited

U.S. PATENT DOCUMENTS

| | | | | |
|---|---|---|---|---|
| 5,901,389 | A * | 5/1999 | Manner | A47G 9/02 5/482 |
| 6,108,836 | A * | 8/2000 | Keene, III | A47G 9/02 5/482 |
| 6,725,477 | B2 | 4/2004 | Ciaglia et al. | |
| 7,086,102 | B1 | 8/2006 | Frazier | |
| 7,140,053 | B1 | 11/2006 | Mangano | |
| 7,231,679 | B2 * | 6/2007 | Ho | A47G 9/0238 5/500 |
| 7,290,301 | B2 | 11/2007 | Ho | |
| 7,392,556 | B2 * | 7/2008 | Breneman | A47G 9/0207 5/497 |
| 7,487,561 | B2 | 2/2009 | Ho | |
| 8,122,541 | B1 | 2/2012 | Georgatos | |
| 8,635,724 | B2 | 1/2014 | Moorhouse | |
| 8,756,730 | B2 | 7/2014 | MacDonald | |
| 8,950,024 | B1 | 2/2015 | Hudson | |
| 9,038,213 | B2 | 5/2015 | Cuneo | |
| 9,149,136 | B2 | 10/2015 | Mikesell | |
| 9,247,835 | B2 | 2/2016 | Blethen et al. | |
| 9,265,368 | B2 | 2/2016 | Blethen et al. | |
| 9,420,904 | B1 | 8/2016 | Russell | |
| 9,510,698 | B1 | 12/2016 | Krotova | |
| 9,549,625 | B1 | 1/2017 | Wilkinson et al. | |
| 9,675,189 | B2 | 6/2017 | Jensen et al. | |
| 9,782,024 | B1 | 10/2017 | Hoger | |
| 9,826,848 | B2 | 11/2017 | Stinchcomb | |
| 9,872,575 | B2 | 1/2018 | Mikesell | |
| 9,907,418 | B2 | 3/2018 | Dunwood | |
| 9,924,813 | B1 | 3/2018 | Basten et al. | |
| 10,016,078 | B1 | 7/2018 | McDermott et al. | |
| 10,070,741 | B1 | 9/2018 | Sofro | |
| 10,154,742 | B2 | 12/2018 | Kazoglou | |
| 10,349,761 | B2 | 7/2019 | Binali et al. | |
| 10,729,260 | B2 | 8/2020 | Suchman et al. | |
| 10,786,099 | B2 | 9/2020 | Reuben | |
| 11,064,825 | B2 * | 7/2021 | Serafini | A47G 9/02 |
| 2008/0115271 | A1 * | 5/2008 | Wiley | A47G 9/02 5/482 |
| 2009/0178197 | A1 * | 7/2009 | Swihart | A47G 9/02 5/502 |
| 2009/0205133 | A1 | 8/2009 | Thomas | |
| 2011/0302715 | A1 * | 12/2011 | Battaglia | A47G 9/02 5/493 |
| 2022/0296013 | A1 * | 9/2022 | Matusak | A47G 9/08 |

* cited by examiner

RECONFIGURABLE BEDDING STABILITY SYSTEM

FIELD OF THE INVENTION

The invention concerns bedding systems that resist disarray of their components while in use, and which can be reconfigured.

BACKGROUND

Some sleep factors are emerging as unexpected components in physical and mental health.

Generally, a quarter or more of the population develops acute insomnia (AI) each year, which is characterized by difficulty going to sleep, staying asleep, and or sleeping for long enough. This trend applies regardless of race, ethnicity, gender, income level, or body mass index. See *Science Daily*, "One in four Americans develops insomnia each year . . . " (June 2018). AI is often stress-induced and differs from sleep deficits that arise from an overfull schedule. In somewhat over 70% of cases AI resolves itself without recurrence, however over 20% of victims remain poor sleepers with recurring bouts; in 6-7% of cases AI becomes chronic. The insomnia statistics have worsened during the current pandemic.

Chronic insomnia is defined as difficulty sleeping for at least three nights per week, and lasting more than three months. Its effect of irritability is well known by the public, but chronic insomnia can also lead to or aggravated diabetes, cardiovascular disease, hypertension, obesity, Alzheimer's disease, other dementia, depression, and complication of mental illness. Mitigating measures such as napping and sleeping in on weekends are often counterproductive for chronic insomnia. See, e.g., Clea Simons, "Insomnia in a Pandemic," *The Harvard Gazette*, Apr. 16, 2020.

Better mitigation may be obtained by controlling sleep environmental factors. A large 2010 poll commissioned by the National Sleep Foundation identified several such factors. Some of these are unsurprising, such as the need for a dark, quiet, clean room that is cool and has fresh air flow. Also, sleep was assisted by a comfortable mattress with breathable sheets appropriate for the season (e.g., flannel in winter versus plain cotton in summer). And many people reported that they slept better when their sheets smelled fresh. But in a more surprising finding, the likelihood of sleeping well is 19% higher when the bed has been made beforehand.

"Made" beds can quickly become disheveled and less comfortable for a variety of reasons. These include normal tossing and turning, but also include restless activity associated with medical factors such as sleep apnea, depression, enlarged prostate, anxiety, "restless leg syndrome" (RLS), or simply young age. Thus, there is a vicious cycle in which a sleep-facilitating factor—being tucked into a well-made bed—is undermined by physiological impulses that grow worse with sleep deficits. Thus, there an ongoing need for improvements in bedding comfort.

SUMMARY OF THE INVENTION

The inventor has found that fully or partially made-bed arrangements can be stabilized by integrating the bedding components. The invention is a system for retaining sheets and covers in the same respective positions and configurations to keep the bed at least partially made while in use. The system allows combination mattress-fitted bedding to be inverted, such that it can be used in either a left-opening or right-opening orientation, since it is effectively hinged on the other side. An additional advantage is that the bed is easier to make, even for a child.

In a particular embodiment the invention is a reconfigurable bedding stability system comprising:

a) A full-fitted sheet formed from a panel of fabric and characterized by a head end, foot end, side for opening, hinge side, "A" face, and "B" face, wherein the full-fitted sheet further comprises:
   i) four corner seams that are lapped and sewn symmetrically such that the appearance of a respective seam is the same regardless of which face of it is exposed;
   ii) edges at the head end, foot end, and sides, wherein the edges define a perimeter;
   iii) elastic constraints along its perimeter such that the sheet, when fitted, forms a mattress pocket capable of anchoring to a mattress;

b) a foot-fitted flat sheet formed from a panel of fabric and characterized by a head end, foot end, side for opening, hinge side, "A" face, and "B" face, wherein the foot-fitted sheet further comprises:
   i) two corner seams at the foot end that are lapped and sewn symmetrically such that the appearance of a respective seam is the same regardless of which face of it is exposed;
   ii) the foot end of the foot-fitted flat sheet is sewn to the foot end of the fitted sheet at their perimeters, defining an end attachment;
   iii) the hinge side of the foot-fitted flat sheet is sewn to the hinge side of the fitted sheet at their perimeters for a distance running from the foot end to at least half-length of the fitted sheet, defining a side attachment;
   iv) the side for opening of the foot-fitted flat sheet is free of attachment to the full-fitted sheet, in that no more than twelve inches of attachment exist along that side from the near corner at their respective foot ends; and
   v) the respective "A" faces of the full-fitted sheet and foot-fitted sheet are oriented toward each other and the sheets form a sleeping envelope capable of enveloping a user, and when the sleeping envelope is inverted the respective "B" faces of the full-fitted sheet and foot-fitted sheet are oriented toward each other and the sheets form a sleeping envelope capable of enveloping a user, such that inverting the sleeping envelope changes the side for opening from right to left or vice versa;

c) sewn-in elastic straps wherein:
   i) a plurality of elastic straps is sewn between the foot end of the foot-fitted flat sheet and foot end of the full-fitted sheet, such that the sewing bisects each such strap;
   ii) a plurality of elastic straps is sewn between the hinge side of the foot-flat sheet and hinge side of the full-fitted sheet, such that the sewing bisects each such strap; and
   iii) each half of each bisected strap defines at least one orifice suitable to serve as a button-hole; and d) a cover that is rectangular with angular or rounded corners, and that has a top face and a bottom face, wherein:
   i) the bottom face has an array of sewn-on buttons for which the placement corresponds to the length and spacing of the bisected strap halves, and wherein the array comprises a U-shaped constellation of buttons;

ii) each sewn-on button is of a diameter and thickness suitable for mating with a defined orifice in a bisected strap half; and iii) the cover may lay flat and juxtaposed against the foot-fitted flat sheet when respective buttons are mated with respective defined orifices in the strap halves and the bedding stability system is mounted on a mattress.

DETAILED DESCRIPTION OF THE INVENTION

Figure 1:
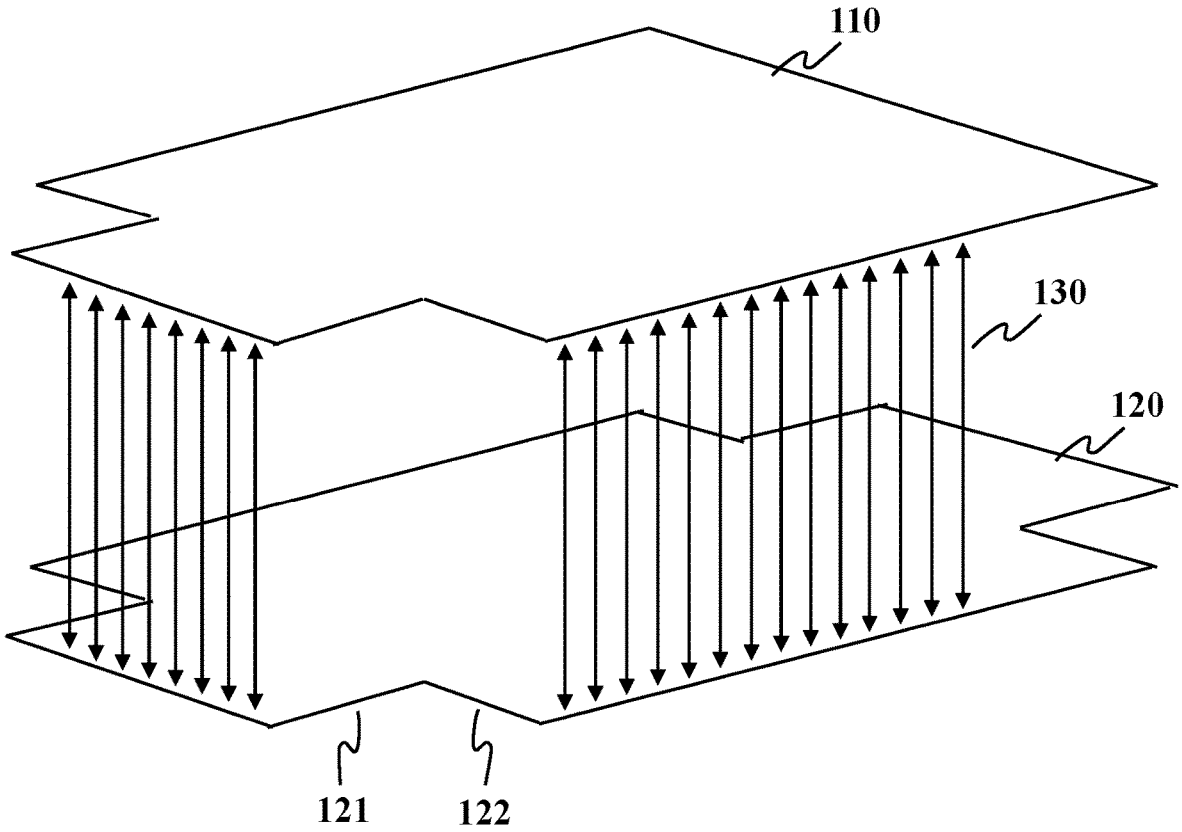
FIG. 1 depicts a caricature with a non-limiting illustration of seam locations for joining a flat sheet and a fitted sheet in construction of a bedding ensemble according to the invention.

The invention may be better understood by considering the following definitions for terms as used herein.

"Bedding" has its usual and ordinary meaning in the field of sleeping mattresses for human use, and includes bed clothes such as sheets, covers, and pillow cases.

"Sheet" has its usual and ordinary meaning in the art of bedding, and includes both flat sheets, fitted sheets, and permutations thereof. The term sheet is not dependent on the choice of fabric, weave or knit or lack thereof, or composition. In certain embodiments the sheet is comprised of a fabric selected from the group consisting of cotton, linen, bamboo textile, flannel, satin, silk, microfiber textile, jersey textile, fleece textile, terrycloth, nylon, rayon, polyester, cotton/polyester, cotton/bamboo, cotton/rayon, and nylon/polyester, as those terms are used in the art.

"Perimeter" as used with respect to a sheet means a zone at or very near its edges, such as along the foot end, head end, and sides. In particular embodiments the perimeter includes seams found at or near its edges, such as for instance elastically constrained seams around the edges of a full-fitted bottom sheet.

"Box-corner feature" as used with respect to a sheet means that the sheet has been sewn to fit over the top and two sides of a mattress at a respective corner. Full-fitted sheets have four box-corner features, and they reside at each corner of the sheet. Foot-fitted sheets have two box-corner features, and they reside at the two corners at the foot end of the sheet. In certain embodiments a quadrilateral is cut from that corner, and a seam is sewn to connect the cut edges. In various embodiments no fabric is cut from the corner, and a seam is sewn to connect folded edges of the sheet. In some embodiments the box-corner feature is entirely defined by right angles. In particular embodiments the edges defined by the box-corner feature are rectilinear. In other embodiments at least one edge defined by the box-corner feature is curvilinear.

"Bedding stability system" means a configuration whereby bedding is stabilized to minimize disturbance of a made-bed arrangement during sleep.

"Reconfigurable" as used with respect to a bedding stability system means that the bedding may be reversed in order to switch from a left-opening to a right-opening configuration and vice versa.

"Inverted" as used with respect to a bedding stability system means that two sheets are sewn face-to-face along at least two sides, and the envelope formed thereby is turned inside out. The term "reversed" applies regardless of whether a seam joining the sheet protrudes outside the sheets or is hidden between the sheets, before the reversal is applied.

"Full-fitted" as used with respect to a sheet means that it is rectangular and has been sewn to form box corners at each of its four corners, such that the sheet is capable of conforming to and enclosing a mattress along its exposed surfaces when oriented for use, including a horizontal top and four vertical side surfaces. In certain embodiments a full-fitted sheet may have a sufficiently long corner seems to fit over both a mattress and its underlying foundation or boxspring. In particular embodiments a full-fitted sheet has a sufficiently long corner seems to fit over a mattress.

"Foot-fitted" as used with respect to a sheet means that it is rectangular and has been sewn to form box corners at the two corners on its foot end, such that the sheet is capable of conforming to and enclosing one end of a mattress along its exposed surfaces when oriented for use.

"Border" as used with respect to a sheet means a margin of fabric, either folded or unfolded, that is continuous with the rest of the sheet or expands it with a sewn additional panel, which extends decoratively beyond a seam. Examples include borders commonly found at the head end of flat sheets, or for the present invention, found at the head end of a foot-fitted sheet. In a particular embodiment the head end of a foot-fitted sheet comprises a border defined by a symmetrically arranged hem such that the appearance of the border and hem is the same when either face is exposed, however the invention is not so limited.

"Rectangular" means a shape having four sides and four corners. For purposes of describing mattresses and sheets, the term rectangular as used herein contemplates both right-angle corners and rounded corners, and includes both straight sides and nonlinear sides such as curved or scalloped sides.

"Fabric" as used herein means cloth comprised of fibers, and prepared by a method such as weaving, knitting, nonwoven technologies, or the like. As used herein the term fabric is not limited by the composition of the fibers.

"Panel" as used with respect to fabric means a piece of fabric. In some embodiments the panel is constituted by a single piece of fabric; in others it comprises a plurality of pieces of fabric that have been attached such as by sewing or another method.

"End" as used with respect to a sheet, cover, or bed means an edge designed by the creator or intended by a user to be nearest to the user's head or feet when in use for sleeping.

"Head end" as used with respect to a sheet, cover, or bed means the end designed by the creator or intended by a user to be nearest to the user's head when in use for sleeping.

"Foot end" as used with respect to a sheet, cover, or bed means the end designed by the creator or intended by a user to be nearest to the user's feet when in use for sleeping.

"Side" as used with respect to a sheet, cover, or bed means an edge designed by the creator or intended by a user to be nearest to the user's hands and arms when in use for sleeping.

"Opening side" and "side for opening" are synonym as used with respect to attached sheets, and mean a side along which there is no attachment between them, and from which a user may readily emerge from between the sheet. Where a bed is against a wall on one side, in some embodiments the preferred side for opening may be on the other side; in some embodiments the preferred side for opening may be on the side nearest to such a wall.

"Hinge side" as used with respect to attached sheets means a side along which there is an attachment between them. This prevents a user from emerging readily from between the sheets.

"Attach" and "attachment" as used with respect to joinder of two sheets refers to a permanently sewn attachment such as a seam or other sewn joint.

"Face" as used with respect to a sheet, cover or seam refers to one or the two faces of the item when viewed as a two-dimensional object, such as the top or bottom face of a horizontally laid sheet or cover, or the inner or outer face of a seam in a sheet's box-corner feature.

"Exposed face" means the face that is on the top or exterior when the item is in use.

"Sleeping envelope" as used with respect to two sheets means that they have been sewn together at their foot ends and at part or all of their hinge sides, wherein a user may sleep between them. When the sleeping envelope is mounted on top of and at four sides of a horizontally oriented mattress, it has a bottom sheet and a top sheet. For a sleeping envelope according to the invention, the perimeter of the bottom sheet—and the perimeter of the top sheet where it is sewn to that of the bottom sheet—may have a placement selected from the group consisting of: (a) entirely below the lower face of the mattress; (b) a circuit along a lower edge of the mattress; and (c) a circuit intermediate between a lower edge and upper edge of the mattress. A bottom sheet perimeter that is entirely underneath the mattress as in (a) commonly arises where an elastic band is sewn into the entire perimeter. A bottom sheet perimeter that is intermediate between a lower and upper edge of a mattress as in (c) may arise where elastic straps pass diagonally underneath the corners of a mattress to hold the sheet there. A bottom sheet perimeter that is located in a circuit along a lower edge of the mattress may arise from either the continuous elastic band or corner diagonal elastic bands.

"Capable of enveloping a user" means that the sleeping envelope defines internal physical boundaries of a size and shape such that a person may fit between the sheets.

"Inverted" as used with respect to a sleeping envelope means that it is turned inside out. Inverting the sleeping envelope changes the side for opening from right to left or vice versa.

"Oriented" as used with respect to faces of two sheets refers to physical placement of the sheets relative to each other.

"'A' face" and 'B' face'" as used with respect to either of two attached sheets, mean that the sheets are permanently attached to one another by sewing along a bottom end and a hinge side, such that when a sleeping envelope formed thereby is in an orientation assigned as the "default orientation", the "A" face of each of the attached sheets is nearest to and opposite the "A" face of the other. In the default orientation each sheet has a "B" face on the envelope's exterior and facing away from its interior. When the default orientation of the sleeping envelope is turned inside out to form its "inverted orientation", the "B" face of each of the attached sheets is nearest to and opposite the "B" face of the other. In this inverted orientation each sheet has its "A" face on the envelope's exterior and facing away from its interior. When no sleeper or object is between the sheets of the sleeping envelope, the sheets may lay flat and juxtaposed against one another.

"Label" means writing and or images on a sheet's face. The label may be printed, embroidered, laminated, on a sewn patch, or otherwise affixed to the sheet. Labels may be used, for example, to indicate which sheet faces should be on the exterior of a sleeping envelope in order to open on the left side or in the alternative the right side, as viewed by an observer standing at the foot end of a mattress on which the envelope is mounted.

The term "corner seam" is best illustrated by an example. A fitted sheet that covers a horizontally-oriented mattress has four corner seams; each of these corner seams is approximately vertical in that position, and connects respective tabs or folds from an end and a side of the sheet to form a feature having approximately the shape of a box corner. In certain embodiments the corner seam includes an elastic member that permits stretching and shrinking of the seam to fit mattresses which share the same in-use top dimensions but differ in thickness. "Elastic member" for purposes of a corner seam means a reversibly stretchable component such as a band, strip, or cord that is sewn to or into the corner seam.

"Lapped" as used with respect to seams means that one piece of cloth overlaps another, and the sewing of the seam holds the lapping in place.

"Sewn" and "sewing" mean stitched, such as with thread. In particular embodiments the sewing: connects two or more panels of fabric; passes through a folded panel to lock in the folded position; stabilizes a fabric edge from unraveling; reinforces the internal edges of a button hole; attaches an elastic item to one or more panels of fabric; or attaches a button to a panel of fabric; however the sewing and the invention are not limited to those purposes. The term includes sewing that follows any of: a continuous path to define a seam; an intermittent path with gaps between sewn portions, thereby forming an intermittent seam; and a path having stitches in isolated locations such that gaps between them account for most of the length of the path. In certain embodiments multiple closely parallel seams are employed in the sewing. In some embodiments seams cross over one another, whether once or multiple times.

"End attachment" means a sewn attachment where a full-fitted sheet and flat-fitted sheet are sewn together at their respective foot ends.

"Side attachment" means a sewn attachment where a full-fitted sheet and flat-fitted sheet are sewn together along part or all of their respective hinge sides.

"Free of attachment" as used with respect to a full-fitted sheet and foot-fitted sheet at their respective sides for opening means that the foot-fitted sheet is not attached to the full-fitted sheet beyond twelve inches from the corner at the foot end. From their common corner at the foot end to a maximum of the first twelve inches, they may or may not be attached on that respective side of each, at the maker's discretion.

"Lapped and sewn symmetrically" means that when viewed from either face of the seam, and whether the sewn item is turned inside out or not, the seam looks the same.

"Elastically constrained" as used with respect to a full-fitted sheet means that one or more elastic bands is attached along its edges such as by stitching, snaps, staples, containment within a sleeve, or other attachment means, thereby forming an elastically stretchable perimeter around the bottom face of a horizontally oriented mattress, when the sheet is placed on top of and around a horizontal mattress. Such a full-fitted sheet may have a corner seam that is longer than the mattress thickness by up to three inches or more, such that the elastic perimeter wraps around the underside of the mattress at its edges. Where a full-fitted sheet is intended for use with a mattress that is thicker than the length of the sheet's corner seam, the term "elastically constrained" means that in addition or as an alternative to the elastic perimeter, the sheet is characterized by four elastic components that are sewn or clipped to the sheet such that each respective elastic component runs from an end to a side of the sheet and can be wrapped under a different respective corner of the mattress. In some embodiments those elastic components have the shape of a strap; in certain embodiment they have the shape of a triangle.

"Capable of anchoring to a mattress" as used with respect to a full-fitted sheet means that the sheet's elastically constrained perimeter is capable of wrapping around the underside of the mattress at its edges, and or that four elastic components attached are capable of wrapping respectively diagonally under each of the four corners of the mattress.

"Mounting" of a bedding stability system or full-fitted sheet on a mattress means that when the mattress is horizontal, the system or sheet covers the top and part way or completely down the ends and sides of the mattress. "Mounting" in that context further means that an elastic perimeter of the bedding stability system or sheet extends part of the way under the bottom edges of the ends and sides of the mattress on all ends and sides and or that diagonally placed elastic components on the system or sheet reach under the mattress at all four corners.

"Mattress" has its usual and ordinary meaning in the art of sleep support devices. The term mattress includes but is not limited to: innerspring mattresses; foam mattresses; feather-filled mattresses; futons; innerspring futon mattresses; pillow-top mattresses; divans; mattresses with toppers; bladder mattresses such as for instance, air mattresses and waterbeds; and the like. As the term is used herein, a mattress has a top, underside, two ends, and two sides, however the ends may also be called sides such that the mattress has four sides. "Exposed surface" of the mattress means a surface is at a position other than the bottom when the mattress is laying horizontally, specifically its top and four sides. Sides of the mattress may be approximately vertical or may be curved, and they define a perimeter when the mattress is in that position.

The common names for sizes of mattresses and respective bedding used with each of them have the same meaning here ordinarily attributed to them in American markets. Specifically, the following terms correspond to the mattress dimensions in the table below, in inches and cm, however the invention is not limited by the mattress size or whether it is in a particular classification. In particular, it is not uncommon to find custom-made mattresses; also, undersized mattresses are commonly used in recreational vehicles; in either case, the present invention can be adapted for them. Note that mattress thickness depends on the maker and with the exception of the toddler and crib size (up to 6 inches thick), typically a manufacturer offers the same thickness options across all sizes. These may be in three categories: light users (up to 130 lbs., mattresses up to 10 inches thick), average users (130-230 lbs., mattresses 8-12 inches thick, and often preferred 11-12 inches thick), and heavy users (over 230 lbs., mattresses 11-18 inches thick, and often preferred over 12 inches thick).

| MATTRESS SIZE | WIDTH | LENGTH |
|---|---|---|
| Toddler | 28 in. (71 cm) | 52 in. (132 cm) |
| Crib | 28 in. (71 cm) | 52 in. (132 cm) |
| Twin | 38 in. (97 cm) | 75 in. (190 cm) |
| Twin XL | 38 in. (92 cm) | 80 in. (203 cm) |
| Full/Double | 54 in. (138 cm) | 74 in. (188 cm) |
| Full/Double XL | 54 in. (138 cm) | 80 in. (203 cm) |
| Queen | 60 in. (153 cm) | 80 in. (203 cm) |
| Olympic Queen | 66 in. (168 cm) | 80 in. (203 cm) |
| (Eastern) King | 76 in. (183 cm) | 80 in. (203 cm) |
| California (Western) King | 72 in. (173 cm) | 84 in. (213 cm) |
| Super King | 80 in. (203 cm) | 80 in. (203 cm) |
| Texas King | 80 in. (203 cm) | 98 in. (249 cm) |
| Wyoming King | 84 in. (213 cm) | 84 in. (213 cm) |
| Alberta King | 96 in. (244 cm) | 96 in. (244 cm) |
| Super Caesar | 108 in. (274 cm) | 84 in. (213 cm) |
| Alaskan King | 108 in. (274 cm) | 108 in. (274 cm) |

"Mattress pocket" as used with respect to sheets means a mattress-shaped, mattress-sized pocket, though not completely covered on its underside by the sheet, such as the pocket found in full-fitted sheets.

"Elastic strap" means a length of material that is comprised of a reversibly stretchable composition. The strap may be rectangular, oval, or another shape, and may have a large, small, or intermediate aspect ratio of length versus width. In a particularly useful embodiment, each strap defines a plurality of button holes along its length, allowing for variations in cover placement or tightness, and for facile adaptation if a button hole becomes worn.

"Sewn-in elastic strap" as used with respect to straps bisected at edges of a sleeping envelope means an elastic strap that is attached by sandwiching it between a full-fitted sheet and flat-fitted sheet, and sewing such that the strap is stitched by a seam that connects the two sheets. "Bisecting" the strap by such a seam means that the seam runs across and through approximately the center of the strap length, such that roughly half the strap extends from one side of the seam and roughly half the strap extends from the seam's other side. In certain embodiments the sleeping envelope has at least the following straps: (a) two bisected straps at the foot end respectively sewn at positions corresponding to one-quarter and three-quarters of an intended mattress size's width, relative to a corner at the foot end; and (b) two bisected straps at the hinge side respectively sewn at positions corresponding to one-third and two-thirds of an intended mattress size's length, or within six inches of such a position, relative to a near corner at the foot end.

"Strap half" and "half strap" are used synonymously, and refer to half of a strap extending from one side of a seam. In preferred embodiments of the invention, some straps are bisected by a foot-end attachment and or at its corners and some straps are bisected by a hinge-side attachment and or at its foot end corner. In certain embodiments the strap is attached at the sleeping envelope's foot end, at its hinge side, at the corner where the foot end and hinge side meet, or at the corner where the foot end and the side for opening meet.

"Button" has its usual and ordinary meaning in the art of sewing, and is independent of the composition. In certain embodiments the button has a composition selected from the group consisting of synthetic polymer, wood, bone, ivory, vegetable ivory, fabric, stone, seashell, ceramic, glass, buckhorn, leather, paper, pressed cardboard, mother-of-pearl, composite, papier-mâché, and metal. The term button is not limited by its shape, size, or whether the button is solid or hollow; nor is it limited by its design, whether it is a shank button, flat button, stud button, or pressure button; nor is it limited by whether it is a covered button, Mandarin button, or worked button.

"Sewn-on button" means a button that is sewn onto the cover, whether directly onto a face of it or by sewing onto a piece of cloth that protrudes from the cover. "Placement" of a sewn-on button that "corresponds to the length and spacing of a bisected strap half" means that when the bedding system is mounted on a mattress, the intended button hole on the strap is within reach of and able to be mated with the button; in certain embodiments the strap must be stretched to accommodate that mating; in certain other embodiments the button may be mated to the button hole without stretching the strap.

"An orifice suitable to serve as a button hole" in a strap means a gap suitable for mating with and retaining a button from a cover. In certain embodiments internal edges of the button hole are reinforced by stitching. A strap half may have more than one button hole. In certain embodiments each strap half has a series of button holes proceeding along its length from the seam connecting it to the sleeping envelope to approximately the end of the strap. In certain embodiments the buttons and button holes corresponding to straps at the foot end of the sleeping envelope are of a different size or shape than he buttons and button holes corresponding to straps at the hinge side of the sleeping envelope. The elasticity of the strap accommodates movement by the sleeper without transferring excessive strain to the button attachment.

"Mating" of a button with a button hole means that the button is pushed through the button hole and held in place there. A "strap-mating" button on a cover is a button that is mated with a button hole in a strap half. In certain embodiments a button may be mated with respective button holes in more than one strap. In various embodiments more than one button hole in a strap may be mated with respective different buttons.

"Diameter and thickness suitable for mating" as used with respect to a sewn on button means that its dimensions are amenable to pushing the button through a button hole and retaining the button there once that is done.

Optional "color-coding" of straps refers to: (a) use of a first color for material or button-hole stitching therein for straps attached at the foot end of the sleeping envelope and a second color for material or button-hole stitching therein for straps attached at the hinge side of the sleeping envelope; and or (b) use of an optionally corresponding color for buttons intended to mate with button holes in straps attached at the foot end of the sleeping envelope and an optionally corresponding color for buttons intended to mate with button holes in straps attached at the hinge side of the sleeping envelope.

"Placement" of a button on a cover means where it is sewn onto the cover. Placement that permits "simultaneous mating" with two strap halves means that the respective strap locations, strap-half lengths, and strap button holes can accommodate mating of the button with a respective button hole on each of those strap halves.

"Cover" as used with respect to a bedding system means a cover such as a blanket, quilt, comforter, coverlet, duvet, bedspread, afghan, and electric blanket. These are non-exclusive illustrative examples. A "rectangular" cover is one that has four edges and four corners that are characterized by angular and or rounded contours. The "center" of the cover is the point that is equidistant from its four corners. The cover's "top face" is the face that is intended to face upward when the cover is in use on a bed. The cover's "bottom face" is the face that is intended to face downward when the cover is in use on a bed, and for the invention has buttons attached on that face for mating with strap halves. In certain embodiments the cover face bearing buttons faces upward and strap halves are extended over the cover for mating with them. In some embodiments the cover has sewn-on buttons on both faces for mating with strap halves, and at the user's discretion the strap halves may be mated to: buttons on the cover's underside; buttons on the cover's topside; or some buttons on the cover's underside and some buttons on the cover's topside. In various embodiments the cover may be used with either face facing upward. In particular embodiments, when no person or object occupies the sleeping envelope, the cover may lay flat and juxtaposed against the foot-fitted flat sheet when the buttons are mated to the strap halves but the invention is not so limited.

"Array" and "constellation" are used synonymously with respect to button placement, and mean the pattern of the placement relative to each other.

A "U-shaped constellation of buttons" on a cover means that the buttons are attached to the cover in a pattern that allows attachment of near straps from either side or the bottom end of the cover. In certain embodiments the constellation comprises four buttons that define the corners of a quadrilateral. In certain other embodiments the constellation comprises two buttons defining a line near the hinge side of a corresponding sleeping envelope, two buttons defining a line near the opening side of the sleeping envelope, and two buttons defining a line near the foot edge of the sleeping envelope, and where no button is placed at an intersection of such lines.

"Launderable" as used with respect to an item made of fabric means able to be cleaned.

"Washing protocol" means a method and conditions for washing and optionally drying fabric. In certain embodiments the sheets and cover are all launderable by the same washing protocol. In some embodiment the cover is launderable by a different washing protocol from that used for the sheets, and is separated from the sheets to carry out part or all of its washing protocol.

"Plurality" means two or more of an item in view.

The articles "a" and "an" are used in the singular, but do not imply that the noun modified thereby is limited to the singular unless the text or context so indicates.

"Comprises" and "comprising" have their usual and ordinary meaning in U.S. law on patent claim construction, i.e., they mean "includes" and "including" respectively.

I have found that prior systems to attach components of bedding to each other can be problematic in any of several ways. Some are overly restrictive of a user's movements. Some require attachment means at sites where they scratch or irritate the sleeper. Some require noisy attachment means such as VELCRO strips. Some require attachment means at sites whereby a sheet tears if the user tosses or turns during sleep. Some attach a cover to a bottom sheet without a protective top sheet, thereby requiring more frequent laundering of a difficult-to-wash cover and also eliminating the option for sheet-only coverage on warm evenings. And so on. The present invention solves several of these long-standing problems.

The invention provides a bedding stability system comprising: (1) a fitted bottom sheet, meaning that can wrap around a horizontal mattress at all four corners; (2) a hybrid top sheet that is fitted at the two corners at the foot end of the mattress; and (3) a cover.

The fitted corners of each sheet have symmetrically sewn corner seams. I.e., for an individual sheet the corner seams look the same from either face. Also, the top sheet at its head end looks like a flat sheet, and has a hem or border with a symmetrically sewn seam there; i.e., it looks the same from either face.

The bottom sheet has elastic at its perimeter that attaches at least the sides of each corner of the sheet, in order to retain the sheet on a mattress.

The top sheet is sewn to the bottom sheet at their perimeters along their foot ends and substantially up one side, i.e., in an "L" pattern. The seam may have a gap, for instance at the corner that is common to the foot end and sewn side. The two sheets thus form an envelope for a sleeper on a mattress, and this may be turned inside out. In the default orientation (with the sheet "A" faces against each other) the envelope opens on one side of the bed; when it is turned inside out (such that the sheet "B" faces are against each other) the pocket opens on the other side. Labels may be printed or sewn on sheets such that their "A" and "B" sides are readily identified when mounting the sleeping pocket on a mattress so that they open on a preferred side.

The seam between the sheets bisects elastic straps such that approximately half the length of each strap lays on either side of the seam. There are a plurality of such straps at the foot end and a plurality of them at the sewn side, and each strap half has at least one button hole.

The cover has a plurality of buttons on its underside. These buttons are used for mating to the button holes in the strap halves. Applicant has found that buttons sewn to sheets for combining them or mating with a cover, tend to result in tearing of the sheet. In a particular configuration the button positions define a constellation pattern such as for example a rectangle, "U", inverted "T", cross, or "X". The "U" and rectangle are particularly preferred; the rectangle is a type of "U" because it allows attachment from the bottom and to either side. The separability of the cover from the sheets allows for those components to differ in their laundering protocols.

Also, in a preferred embodiment, when the sheets and cover are mounted on the mattress and mated by the strap halves, the top sheet does not extend beyond the edge of the cover on the opening side. Thus, the top sheet does not "peek" out indecorously from below the cover when the bed is made. However, the invention is not so limited.

The straps and buttons may be color-coded, for instance with foot-end straps being one color and side straps another color, where cover buttons have colors corresponding to those in the straps. This can distinguish the foot edge from the side edge of a perimeter joining seam.

Further, a label may be used to identify which faces of the sleeping envelope should face outward in order to have the envelope open toward a preferred side of the bed.

Consideration of the FIGURES will further clarify the invention, as described below. Each figure is a caricature depicting a non-limiting illustration of features of the invention.

FIG. 1 is a caricature that simplifies some features of the invention in order to draw more attention to others. There 120 represents a bottom sheet. The notches facilitate formation of fitted corners, for instance edges 121 and 122 will be overlapped and sewn together with a seam. Thus 110 represents a top sheet, and its notches at two corners are located at the foot end, for preparation of fitted corners there. Arrows 130 designate the corresponding areas on each sheet to be mated by a seam; it will be seen that they form the vertical and horizontal portions of the letter "L". In this instance the seam may or may not be continuous at their common corner, for instance a gap may be left between the hinge side and foot end seams in order to facilitate removal of air pockets and debris from between the joined sheets.

Figure 2A:
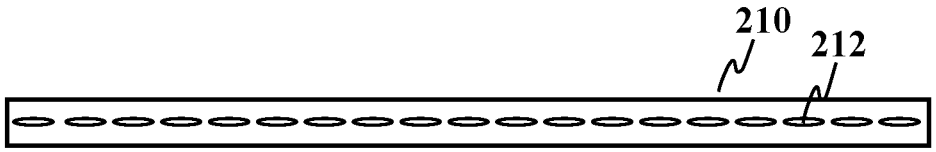
FIG. 2A depicts a caricature with a non-limiting illustration of a strap with button holes for use in a bedding ensemble according to the invention.
Figure 2B:
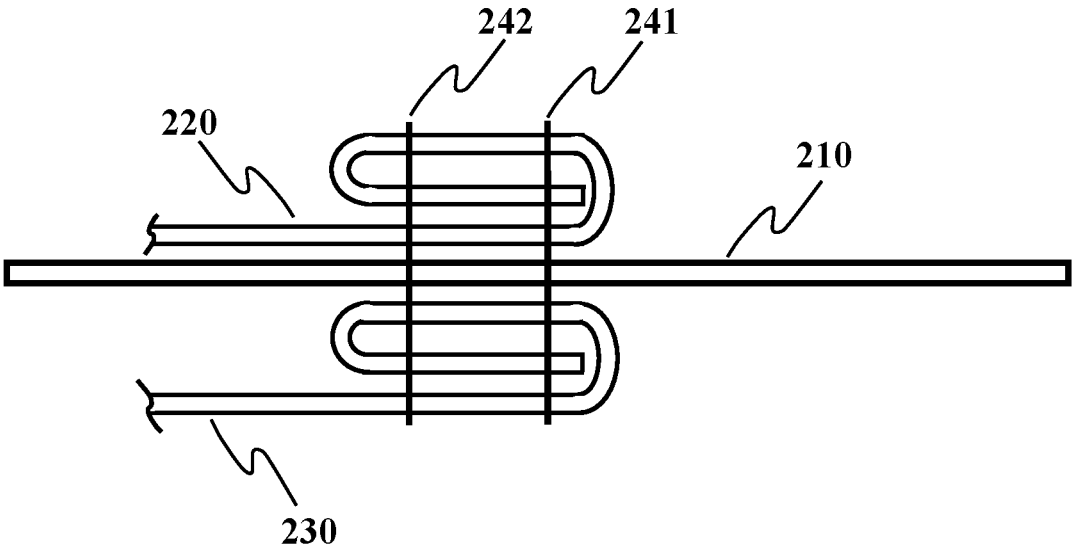
FIG. 2B depicts a caricature with a non-limiting illustration of a cross-sectional view of sandwiching a strap between the perimeters of a flat sheet and fitted sheet in a bedding ensemble according to the invention.

FIG. 2A depicts a caricature of elastic strap 210 with button holes 212. Such a strap is sewn approximately across the midpoint of its length, between the edges of the flat and fitted sheet. This is seen in FIG. 2B, which is a cross-sectional view along the length of strap 210 and across the seam formed. There the edge of fitted sheet 220 is on one side of the strap and the edge of flat sheet 230 is on the other, both sheets being rolled before the resulting sandwich arrangement is stitched together by seams 241 and 242.

Figure 3A:
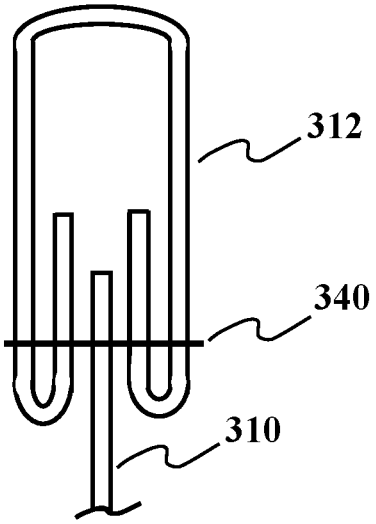
FIG. 3A depicts a caricature with a non-limiting illustration of a cross-sectional view of a symmetrically attached border at the head of a flat sheet for a bedding ensemble according to the invention.
Figure 3B:
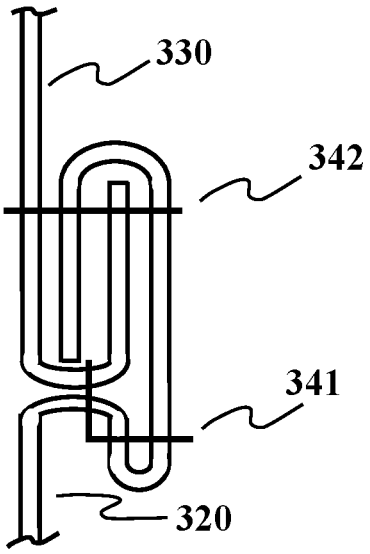
FIG. 3B depicts a caricature with a non-limiting illustration of a cross-sectional view of a lapped, asymmetrically sewn fitted corner in the foot end of a flat sheet for a bedding ensemble according to the invention.
Figure 3C:
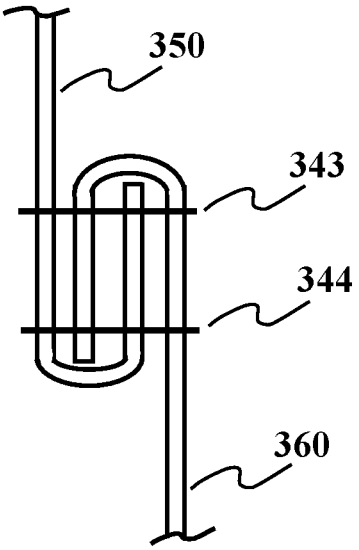
FIG. 3C depicts a caricature with a non-limiting illustration of a cross-sectional view of a lapped, symmetrically sewn fitted corner in the foot end of a flat sheet for a bedding ensemble according to the invention.
Figure 3D:
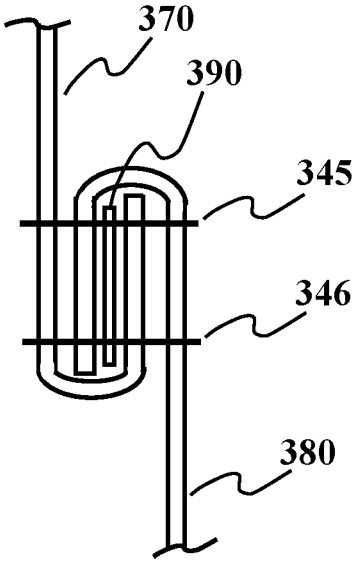
FIG. 3D depicts a caricature with a non-limiting illustration of a cross-sectional view of a lapped, symmetrically sewn fitted corner in the foot end of a flat sheet for a bedding ensemble according to the invention, further containing an elastic member to allow adaptation to more than one thickness of mattress.

FIG. 3A depicts a caricature of a cross-sectional view of a symmetrically attached border piece 312 attached at the head of a flat sheet 310 by a seam 340. FIG. 3B depicts a caricature with a cross-sectional view of a lapped, asymmetrically sewn fitted corner in the foot end of a flat sheet; there the edges 320 and 330 of a notch are first sewn with a first seam 341, and then their perimeters are interfolded and lapped for attachment by a second seam 342. FIG. 3C is a caricature of a cross-sectional view of a symmetrically sewn simpler fitted corner in the foot end of a flat sheet; there the two edges 350 and 360 of a notch are interfolded and lapped for attachment by seams 343 and 344. Note that such double seams may be parallel to one another, or may for instance form complementary zig-zags or other patterns. FIG. 3D depicts the cross-section of a similar arrangement to that of FIG. 3C, except that the notch edges 370 and 380 are interfolded and lapped around an elastic member 390 before being joined by seams 345 and 346. Such an elastic member can facilitate adaptation of fitted sheet corners to thinner and or thicker mattresses than might otherwise be the case.

Figure 4A:
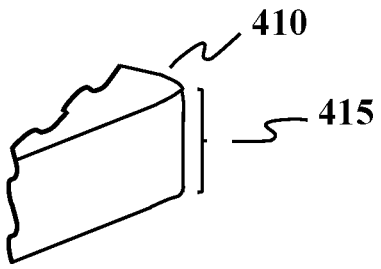
FIG. 4A depicts a caricature with a non-limiting illustration of a cut-out view of a mattress corner having a vertically rectilinear edge.
Figure 4B:
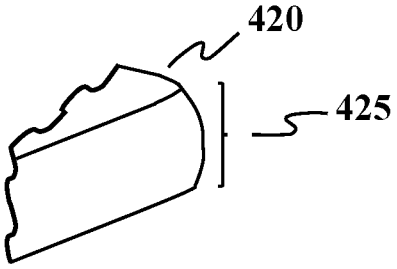
FIG. 4B depicts a caricature with a non-limiting illustration of a cut-out view of a mattress corner having a vertically curvilinear edge.

FIG. 4A depicts a caricature with a cut-out view of a mattress corner 410 having a vertically rectilinear edge 415. In such a case the seam at the vertical edge for a sheet fitted corner may form a straight line with a flat overlapped cloth feature. FIG. 4B depicts a caricature with a cut-out view of a mattress corner 420 having a vertically curvilinear edge 425. In such a case the seam at the vertical edge for a sheet fitted corner may form an arc of the overlapped cloth feature may bow outward instead of lying flat.

Figure 5A:
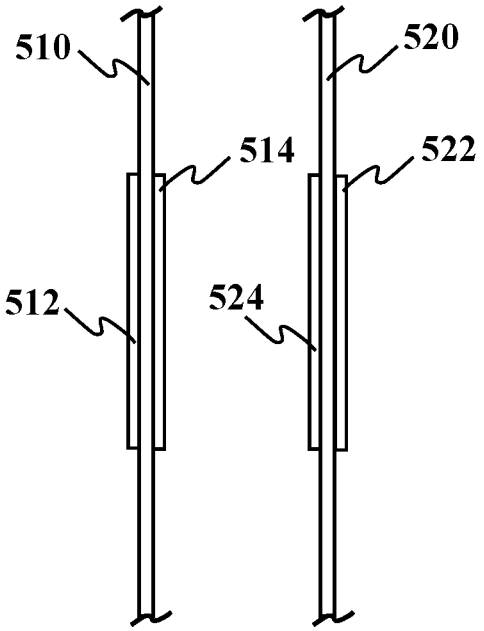
FIG. 5A depicts a caricature with a non-limiting illustration of a cross-sectional view of a flat sheet and fitted sheet in parallel, each bearing an orientation label on both sides.
Figure 5B:
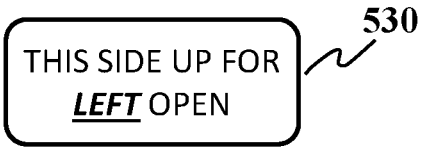
FIG. 5B depicts a caricature with a non-limiting illustration of an orientation label for a sheet for a bedding ensemble according to the invention.
Figure 5C:
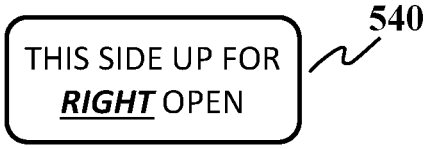
FIG. 5C depicts a caricature with a non-limiting illustration of an orientation label for a sheet for a bedding ensemble according to the invention.

FIG. 5A depicts a caricature of a cross-sectional view of a flat sheet 510 and fitted sheet 520 in parallel, each bearing an orientation label on both sides. For instance labels 512 and 522 may be exposed to announce the "A" side or left-opening configuration, while labels 514 and 524 face inward to announce the "B" side or right-opening configuration, or vice versa. FIG. 5B depicts a caricature of an illustrative printed or sewn label 530 for the left-opening configuration, and FIG. 5C depicts a caricature of an illustrative printed or sewn label 540 for the right-opening configuration. This figure shows use of labels on each side of both sheets, however they may be provided on just one sheet—either the full-fitted or foot-fitted sheet. And for any sheet for which they are provided, it may be on both sides or just one side.

Figure 6A:
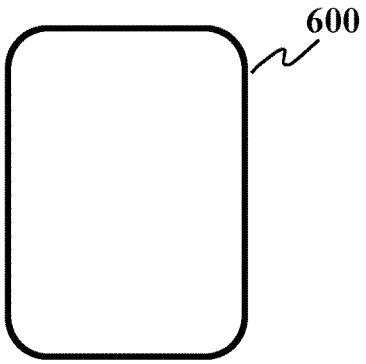
FIG. 6A depicts a caricature with a non-limiting illustration of the top side of a cover for a bedding ensemble according to the invention.
Figure 6B:
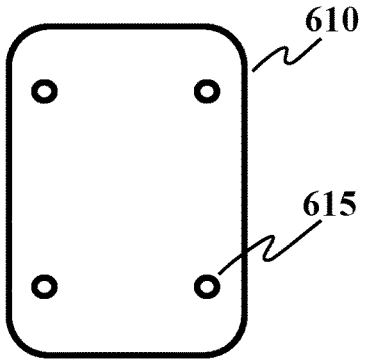
FIG. 6B depicts a caricature with a non-limiting illustration of the underside of a cover for a bedding ensemble according to the invention, in which the cover bears four buttons that define the corners of a quadrilateral.
Figure 6C:
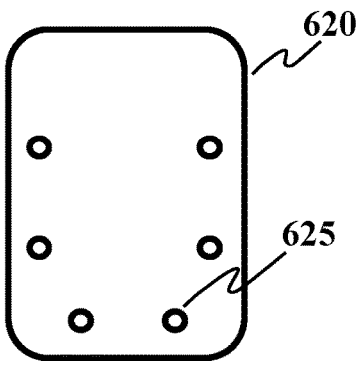
FIG. 6C depicts a caricature with a non-limiting illustration of the underside of a cover for a bedding ensemble according to the invention, in which the cover bears six buttons that define a U-shaped constellation.

FIG. 6A depicts a caricature of the top side 600 of a cover for a bedding ensemble according to the invention. FIG. 6B depicts a caricature of the underside 610 of a cover bearing buttons 615; in this case there are four defining the corners of a quadrilateral. FIG. 6C depicts a caricature of the underside 620 of a cover bearing buttons 625; there the six-button pattern defines a U-shaped constellation.

Figure 6D:
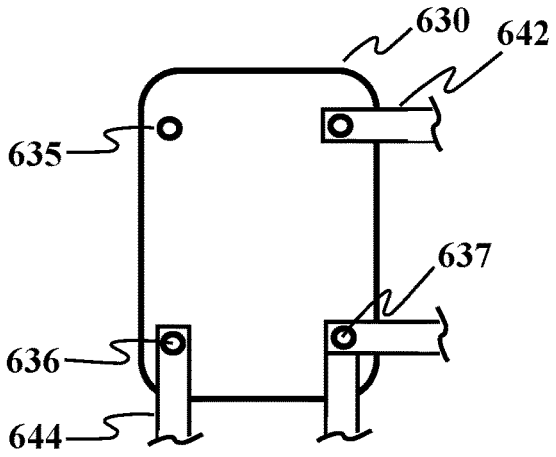
FIG. 6D depicts a caricature with a non-limiting illustration of the underside of a cover for a bedding ensemble according to the invention, in which the cover bears four buttons that define the corners of a quadrilateral and they are attached to straps from the hinge side and the foot end.

FIG. 6D depicts a caricature of the underside 630 of a cover for a bedding ensemble according to the invention; the underside bears four buttons that define the corners of a quadrilateral and they are attached to hinge-side strap ends such as 642 and to foot-end strap ends such as 644; a portion of each straps is not shown. Button 635 remains unattached to a strap. Button 636 is attached to a single strap 644 at a button hole. Button 637 is attached to both a hinge-side and foot-end strap end.

Figure 6E:
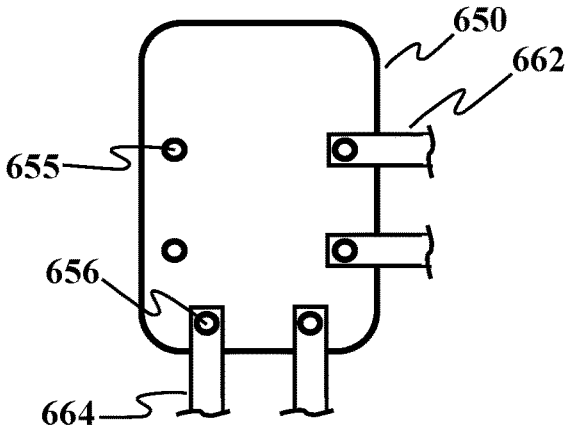
FIG. 6E depicts a caricature with a non-limiting illustration of the underside of a cover for a bedding ensemble according to the invention, in which the cover bears six buttons that define a U-shaped constellation and they are attached to straps from the hinge side and the foot end.

FIG. 6E depicts a caricature of the underside 650 of a cover for a bedding ensemble according to the invention; the underside bears six buttons that define a U-shaped constellation and they are attached to hinge-side strap ends such as 662 and to foot-end strap ends such as 664; a portion of each straps is not shown. Button 665 remains unattached to a strap. Button 656 is attached to a single strap 662 at a button hole. Here no button is attached to both a hinge-side and foot-end strap end.

Figure 7A:
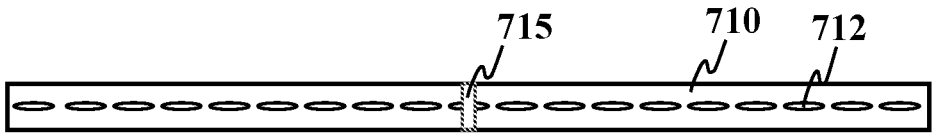
FIG. 7A depicts a caricature of an elastic strap with button holes, wherein the strap is sewn approximately across a midpoint of its length, between edges of a flat and fitted sheet.
Figure 7B:
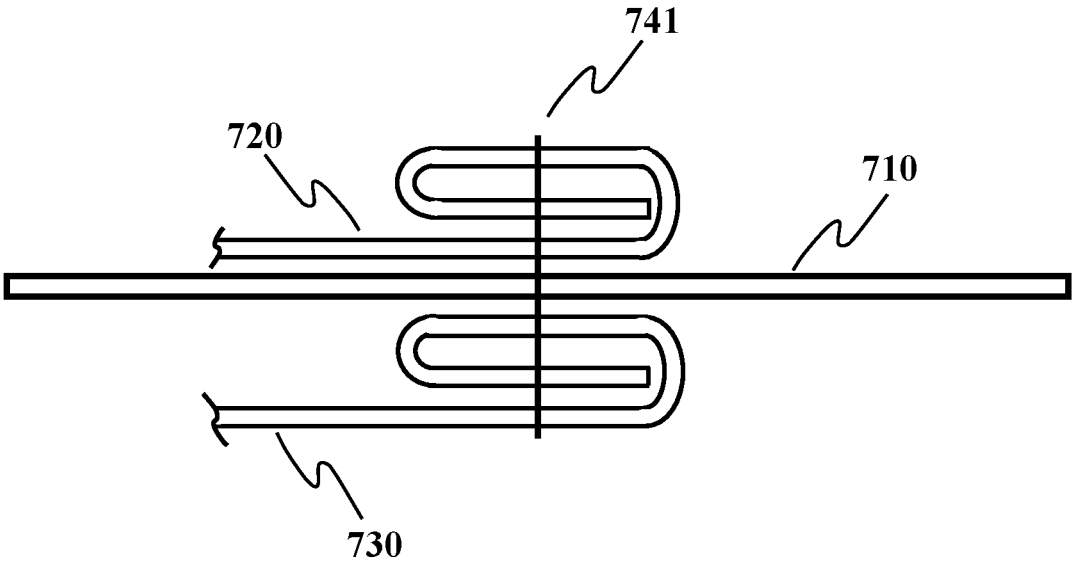
FIG. 7B, depicts a caricature of a cross-sectional view along the length of a strap that is between rolled edges of a fitted sheet and flat sheet, wherein the resulting sandwich arrangement is stitched together by a seam.

FIG. 7A depicts a caricature of elastic strap 710 with button holes 712. Such a strap is sewn approximately across the midpoint 715 of its length, between the edges of the flat and fitted sheet. This is seen in FIG. 7B, which is a cross-sectional view along the length of strap 710 and across the seam formed. There the edge of fitted sheet 720 is on one side of the strap and the edge of flat sheet 730 is on the other, both sheets being rolled before the resulting sandwich arrangement is stitched together by seam 741.

Figure 8:
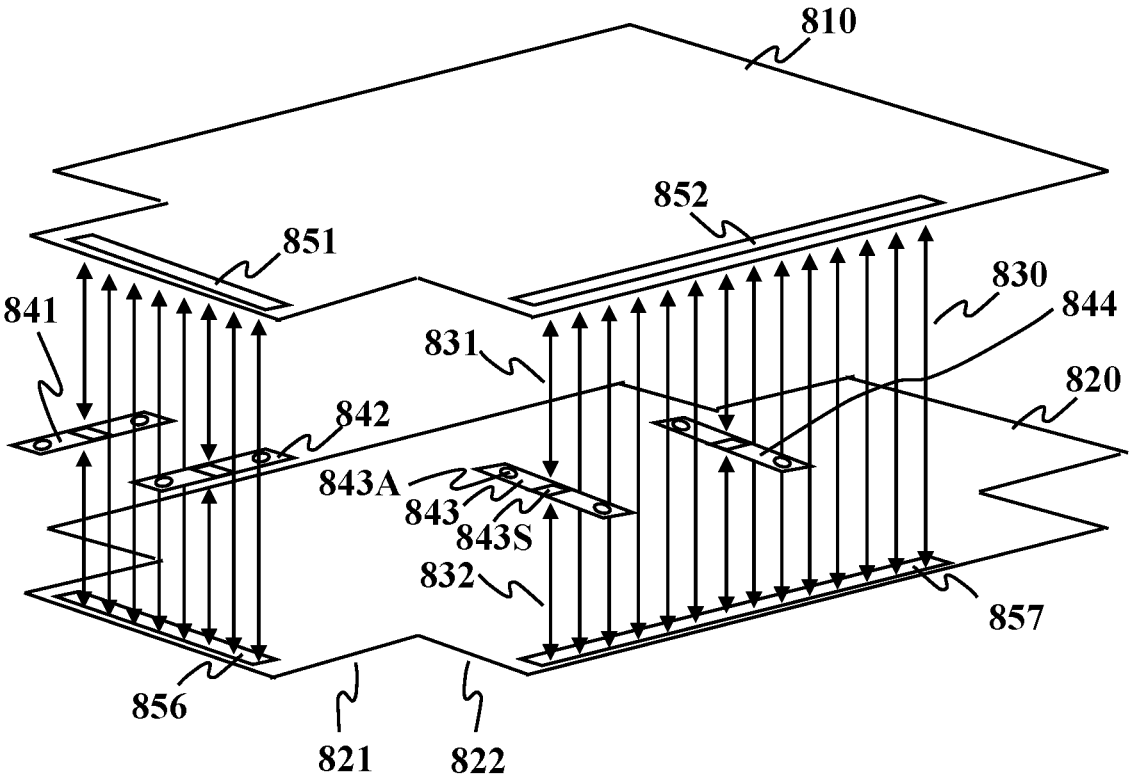
FIG. 8 is a caricature of an exploded view, wherein the four corners of a bottom sheet are notched, two foot-end corners of a top sheet are notched, and the two sheets are mated by a seam at the foot end, a seam on one side, such that those seams also mate the two sheets across the respective midpoints of straps located between them.

FIG. 8 is a caricature of an exploded view that simplifies some features of the invention in order to draw more attention to others. There 820 represents a bottom sheet. The notches facilitate formation of fitted corners, for instance edges 821 and 822 will be overlapped and sewn together with a seam. Thus 810 represents a top sheet, and its notches at two corners are located at the foot end, for preparation of fitted corners there. Arrows 830 designate the corresponding areas on each sheet to be mated by a seam; it will be seen that they form the vertical and horizontal portions of the letter "L". In this instance the seam may or may not be continuous at their common corner, for instance a gap may be left between the hinge side and foot end seams in order to facilitate removal of air pockets and debris from between the joined sheets.

Further in FIG. 8, Straps 841, 842, 843 and 844 are disposed between top sheet 810 and bottom sheet 820. Features of the straps are enumerated for strap 843, specifically each half having an orifice suitable to serve as a button hole as defined at 843A, and a midpoint 843S of its length, approximately across which the assembly is sewn, sandwiching the strap midpoint between the edges of the flat and fitted sheet. Arrows 831 and 832 designate corresponding areas on each sheet to be mated to strap 843 by a seam; this illustrative how the other straps 841, 842 and 844 will be attached, respectively. Seam locations are shown for joining a flat sheet and a fitted sheet in construction of a bedding ensemble according to the invention, where seam locations 851 and 856 are opposite to and will be sewn to one other at the foot end, and seam locations 852 and 857 are opposite to and will be sewn to one another at the hinge side.

The embodiments of the invention as described herein are merely illustrative and are not exclusive. Numerous additions, variations, derivations, permutations, equivalents, combinations and modifications of the above-described invention will be apparent to persons of ordinary skill in the relevant arts and are within the scope and spirit of the invention. The invention as described herein contemplates the use of those alternative embodiments without limitation.

I claim:

1. A reconfigurable bedding stability system comprising:

a) A full-fitted sheet formed from a panel of fabric and characterized by a head end, foot end, side for opening, hinge side, "A" face, and "B" face, wherein the full-fitted sheet further comprises:

i) four corner seams that are lapped and sewn symmetrically such that the appearance of a respective seam is the same regardless of which face of it is exposed;

ii) edges at the head end, foot end, and sides, wherein the edges define a perimeter;

iii) elastic constraints along its perimeter such that the sheet, when fitted, forms a mattress pocket capable of anchoring to a mattress;

b) a foot-fitted flat sheet formed from a panel of fabric and characterized by a head end, foot end, side for opening, hinge side, "A" face, and "B" face, wherein the foot-fitted sheet further comprises:

i) two corner seams at the foot end that are lapped and sewn symmetrically such that the appearance of a respective seam is the same regardless of which face of it is exposed;

ii) the foot end of the foot-fitted flat sheet is sewn to the foot end of the fitted sheet at their perimeters, defining an end attachment;

iii) the hinge side of the foot-fitted flat sheet is sewn to the hinge side of the fitted sheet at their perimeters for a distance running from the foot end to at least half-length of the fitted sheet, defining a side attachment;

iv) the side for opening of the foot-fitted flat sheet is free of attachment to the full-fitted sheet, in that no more than twelve inches of attachment exist along that side from the near corner at their respective foot ends; and v) the respective "A" faces of the full-fitted sheet and foot-fitted sheet are oriented toward each other and the sheets form a sleeping envelope capable of enveloping a user, and when the sleeping envelope is inverted the respective "B" faces of the full-fitted sheet and foot-fitted sheet are oriented toward each other and the sheets form a sleeping envelope capable of enveloping a user, such that inverting the sleeping envelope changes the side for opening from right to left or vice versa;

c) sewn-in elastic straps wherein:

i) a plurality of elastic straps is sewn between the foot end of the foot-fitted flat sheet and foot end of the full-fitted sheet, such that the sewing bisects each such strap;

ii) a plurality of elastic straps is sewn between the hinge side of the foot-flat sheet and hinge side of the full-fitted sheet, such that the sewing bisects each such strap; and iii) each half of each bisected strap defines at least one orifice suitable to serve as a button-hole; and d) a cover that is rectangular with angular or rounded corners, and that has a top face and a bottom face, wherein:

i) the bottom face has an array of sewn-on buttons for which the placement corresponds to the length and spacing of the bisected strap halves, and wherein the array comprises a U-shaped constellation of buttons;

ii) each sewn-on button is of a diameter and thickness suitable for mating with a defined orifice in a bisected strap half; and iii) the cover may lay flat and juxtaposed against the foot-fitted flat sheet when respective buttons are mated with respective defined orifices in the strap halves and the bedding stability system is mounted on a mattress.

2. The bedding system of claim 1 wherein, when the sleeping envelope is mounted on top of and at four sides of a horizontally oriented mattress, and the perimeter of the full-fitted sheet has a placement selected from the group consisting of: (a) entirely below the lower face of the mattress; (b) a circuit along a lower edge of the mattress; and (c) a circuit intermediate between a lower edge and upper edge of the mattress.

3. The bedding system of claim 1 wherein the sewing that attaches the sheet foot ends together and or that attaches the sheet hinge sides together is selected from the group consisting of: continuous stitching; intermittent stitching; and a plurality of isolated stitch sites.

4. The bedding system of claim 1 wherein the head end of the foot-fitted sheet comprises a border defined by a symmetrically arranged hem such that the appearance of the border and hem is the same when either face is exposed.

5. The bedding system of claim 1, further comprising at least one label on a sheet face, wherein when that face is on the exterior the label indicates whether the sleeping envelope will open toward the left or right side as viewed by an observer standing at the foot end of a mattress on which the envelope is mounted.

6. The bedding system of claim 1 wherein: (a) the straps are color-coded, such that the straps on the bottom end are of a single and different color from the straps on the hinge side; and (b) the buttons are color-coded, such that buttons for mating with the foot end straps correspond to the color of those respective straps, and buttons for mating with the hinge side straps correspond to the color of those respective straps.

7. The bedding system of claim 1 wherein placement of a single button on the cover permits its simultaneous mating with a strap half from the bottom end with a strap half from the hinge side.

8. The bedding system of claim 1 wherein buttons and corresponding button holes are of a different size for the foot-end straps than they are for the hinge side straps.

9. The bedding system of claim 1 wherein at least one of the straps is sewn and bisected between the sheets at a corner such that it is shared by their bottom edge and hinge side or shared by their bottom edge and side for opening.

10. The bedding system of claim 1 wherein each strap half defines a plurality of button holes.

11. The bedding system of claim 1, wherein: (a) two straps at the foot end are respectively sewn at positions corresponding to one-quarter and three-quarters of an intended mattress size's width, relative to a corner at the foot end; and (b) two straps at the hinge side are respectively sewn at positions corresponding to one-third and two-thirds of an intended mattress size's length, or within six inches of such a position, relative to a near corner at the foot end.

12. The bedding system of claim 1, wherein the cover is selected from the group consisting of a blanket, quilt, comforter, coverlet, duvet, bedspread, afghan, and electric blanket.

13. The bedding system of claim 1, wherein the buttons have a composition selected from the group consisting of synthetic polymer, wood, bone, ivory, vegetable ivory, fabric, stone, seashell, ceramic, glass, buckhorn, leather, paper, pressed cardboard, mother-of-pearl, composite, papier-mâché and metal.

14. The bedding system of claim 1, wherein each sheets is comprised of a fabric selected from the group consisting of cotton, linen, bamboo textile, flannel, satin, silk, microfiber textile, jersey textile, fleece textile, terrycloth, nylon, rayon, polyester, cotton/polyester, cotton/bamboo, cotton/rayon, and nylon/polyester.

15. The bedding system of claim 1, wherein one or more box-corner features of the full-fitted sheet or foot-fitted sheet are sewn in curvilinear fashion.

16. The bedding system of claim 1, wherein each corner seam of the full-fitted and or foot-fitted sheet includes an elastic member that permits stretching and shrinking of the seam to fit mattresses which share the same in-use top dimensions but differ in thickness.

17. The bedding system of claim 1, wherein the U-shaped constellation of buttons comprises four buttons that define the corners of a quadrilateral.

18. The bedding system of claim 1, wherein the U-shaped constellation of buttons comprises two buttons defining a line near the hinge side, two buttons defining a line near the opening side, and two buttons defining a line near the foot edge, and where no button is placed at an intersection of such lines.

19. The bedding system of claim 1, wherein the sheets are launderable by an identical washing protocol, and the cover is launderable in a fashion selected from the group consisting of: the same washing protocol as for the sheets; and a different washing protocol from the sheets.

20. The bedding system of claim 1 wherein the system dimensions are intended for a mattress size selected from the group consisting of crib, toddler, twin, twin XL, full, full XL, queen, Olympic queen, king, California king, Super king, Texas king, Wyoming king, Alberta king, Super Caesar, Alaskan king size, and recreational vehicle mattresses.

* * * * *